US006273173B1

(12) United States Patent
Lassen

(10) Patent No.: US 6,273,173 B1
(45) Date of Patent: Aug. 14, 2001

(54) UNIVERSAL MOUNTING AND PARALLEL GUIDANCE ARRANGEMENT FOR A WINDOW SCREENING DEVICE

(75) Inventor: Gert Godvig Lassen, Skjern (DK)

(73) Assignee: Velux Industri A/S, Søborg (DK)

( * ) Notice: Subject to any disclaimer, the term of this patent is extended or adjusted under 35 U.S.C. 154(b) by 0 days.

(21) Appl. No.: 09/355,104

(22) PCT Filed: Jan. 23, 1998

(86) PCT No.: PCT/DK98/00027

§ 371 Date: Sep. 14, 1999

§ 102(e) Date: Sep. 14, 1999

(87) PCT Pub. No.: WO98/32944

PCT Pub. Date: Jul. 30, 1998

(30) Foreign Application Priority Data

Jan. 24, 1997 (DK) ..... 0090/97

(51) Int. Cl.[7] ..... A47H 5/00; A47G 5/02
(52) U.S. Cl. ..... 160/84.06; 160/265; 160/310
(58) Field of Search ..... 160/84.04, 84.05, 160/84.06, 265, 310

(56) References Cited

U.S. PATENT DOCUMENTS

| | | | | |
|---|---|---|---|---|
| 612,606 | | 10/1898 | Forsyth . | |
| 684,214 | * | 10/1901 | Forsyth et al. | 160/265 |
| 785,806 | | 3/1905 | Hopkins . | |
| 4,574,864 | * | 3/1986 | Tse | 160/259 |
| 4,733,710 | * | 3/1988 | Haines | 160/84.06 |
| 5,404,926 | * | 4/1995 | Ojima et al. | 160/310 X |
| 5,533,559 | * | 7/1996 | Judkins | 160/84.06 |
| 5,535,806 | * | 7/1996 | Kold et al. | 160/273.1 |

FOREIGN PATENT DOCUMENTS

| | | |
|---|---|---|
| 2 615 240 | 11/1988 | (EP) . |
| 0 549 209 A1 | 10/1992 | (EP) . |
| 0 558 154 A2 | 2/1993 | (EP) . |
| WO 93/18270 | 9/1993 | (WO) . |
| WO 96/22447 | 7/1996 | (WO) . |

* cited by examiner

*Primary Examiner*—Daniel P. Stodola
*Assistant Examiner*—Hugh B. Thompson
(74) *Attorney, Agent, or Firm*—Venable; John P. Shannon

(57) ABSTRACT

The mounting and parallel guidance arrangement comprises a mounting bar (1) designed for releasable interconnection with the bottom bar of the screening device and having a through–going hollowness, two parallel guidance cords (2, 3), each being led through said mounting bar and comprising end parts which protrude from each end of the mounting bar, and installation brackets (4–7) for the free end of each of the end parts. The two installation brackets (4, 6; 5, 7) for a cord are meant to be fastened at the top of a first main frame or sash side member and at the bottom of the other main frame or sash side member opposite in relation to the first one, respectively. The releasable inter-connection of the mounting bar (1) with the bottom bar can be effected by means of clips.

12 Claims, 2 Drawing Sheets

Figure 1:
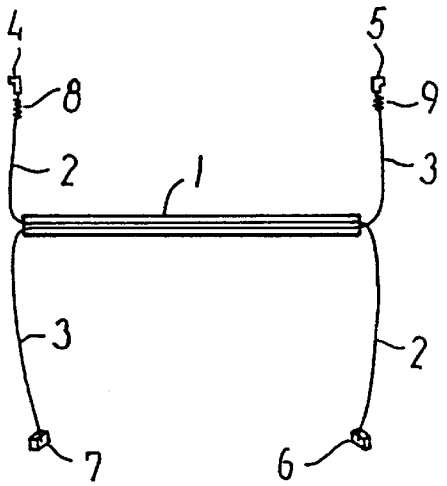

UNIVERSAL MOUNTING AND PARALLEL GUIDANCE ARRANGEMENT FOR A WINDOW SCREENING DEVICE

The present invention relates to a universal mounting and parallel guidance arrangement for at least one screening device for a window, in particular a roof window, where the screening device comprises a body of screening material which in an idle position is rolled up, collapsed, or pleated and occupies a position in or at a main frame or sash member of the window, whereas said body in a free end is connected to a bottom bar, profile rail or strip.

It is well-known, eg. from FR patent application no. 2 615 240 and U.S. Pat. Nos. 612,606 and 785,806, that screening devices in the form of blackout curtains, roller blinds, pleated blinds or Venetian blinds for windows are built together with a parallel guidance arrangement which in a roller blind or pleated blind has e.g. two cord systems, each led from the bottom end of one sash side member through the bottom bar of the blind to the upper end of the opposite sash side member, the cords crossing each other when passing through the bottom bar which is hollow in its entire length.

It is not unusual that especially the cord systems of these known screening devices create problems in connection with the mounting, as the handling of the cords and in particular their positioning in the window sash are not always quite simple and evident, especially not if prior to the mounting, the consumer draws the screening device entirely out in order to have a better look of its colour, form or shape. In addition, the cords are rather easily tangled. Especially in blackout curtains where the screening arrangement also comprises light-proof strips or rails along the sash sides, the mounting is often quite difficult and time-consuming.

The object of the invention is to provide a mounting and parallel guidance arrangement of the initially stated kind where the said drawbacks are set right and which in a simple way can be mounted together with at least one screening device, whether a roller, pleated, or Venetian blind, and whether or not these are provided with a parallel guidance arrangement.

For this purpose, a universal mounting and parallel guidance arrangement according to the invention is characterized in that it comprises at least one mounting bar having a through-going hollowness and designed for a releasable interconnection with the bottom bar, profile rail or strip of the screening device, two parallel guidance cord systems each being led through said mounting bar and comprising end parts which protrude from each end of the stick, and installation brackets for the free end of each of the said end parts whereby the two installation brackets for a cord system are preferably meant for fastening at the top of a first main frame or sash side member and at the bottom of the other main frame or sash side member opposite in relation to the first one, respectively.

Such a mounting and parallel guidance arrangement thus constitutes a kind of a simple base module which can relatively easy be mounted also on already installed windows and can be used with the common screening devices in the form of roller, pleated, or Venetian blinds, and especially such which are not beforehand provided with a parallel guidance arrangement. Such screening devices may e.g. comprise casings, cabinets, cassettes or the like designed with interconnection brackets which can easily be connected with the installation brackets in the base module.

In another appropriate embodiment of the arrangement according to the invention, the parallel guidance cord systems are pretensioned, preferably by pretensioning springs positioned in connection with said installation brackets or by elastic cords or alike.

A particularly good parallel guidance is thus obtained as between the said cord systems and the said mounting bar, a suitable friction will continuously be available for retaining the mounting bar in an arbitrary position, also even if a body of screening material is connected.

According to an advantageous development of the invention, the base module can be designed with a view to electric operation of the screening device by connecting the mounting bar with at least one draw cord which is in connection with an electric operation device comprising a rewinding drum for the draw cord mounted in or at the main frame or sash top or bottom member.

Further details and advantages of the invention will appear from the dependent claims.

Figure 2:
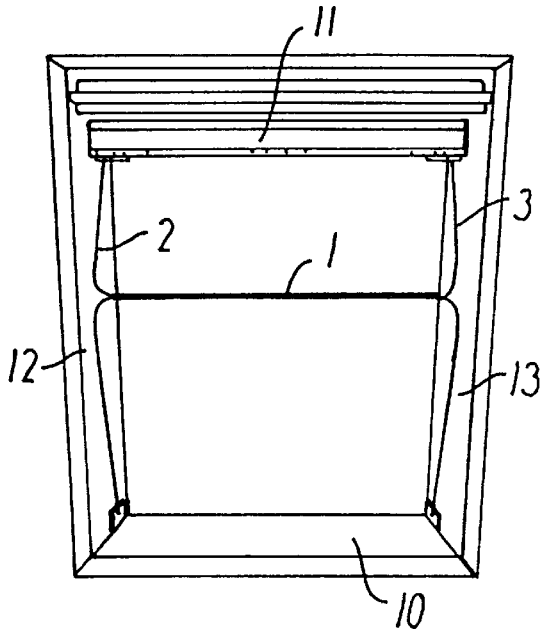
Figure 3:
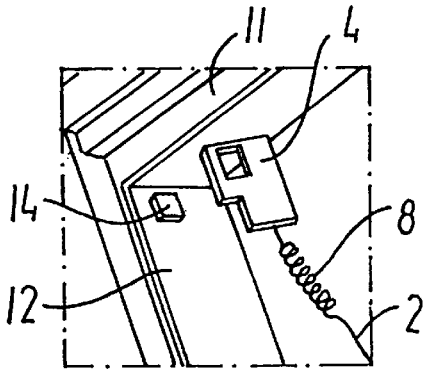
Figure 4:
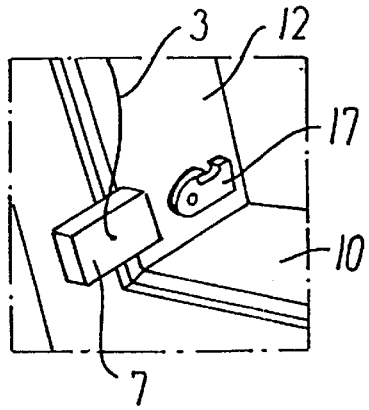
Figure 5:
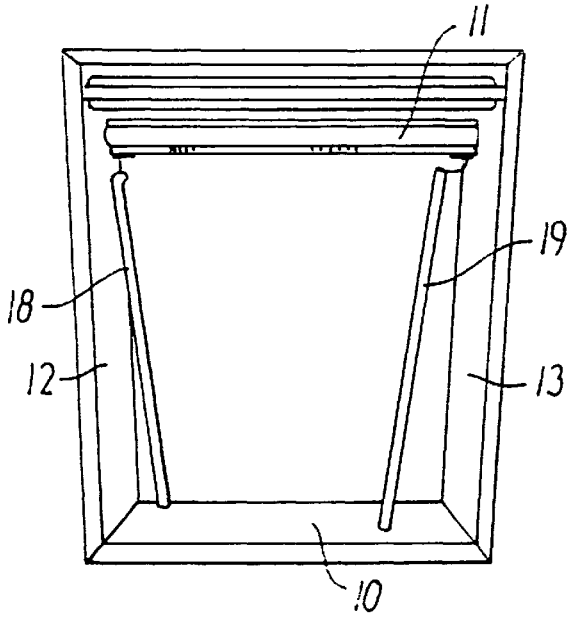

By means of examples of embodiments, the invention is further explained in the following with reference to the schematical drawings where FIG. 1 shows a front view of a mounting and parallel guidance arrangement according to the invention, FIG. 2 a mounting and parallel guidance arrangement according to the invention mounted in a window, FIGS. 3 and 4 show a section of FIG. 2 on a larger scale, FIG. 5 shows a detail of another embodiment for the arrangement according to the invention, and FIG. 6 a view of a further embodiment for the mounting and parallel guidance arrangement according to the invention.

In FIG. 1, a mounting and parallel guidance arrangement is shown in its delivery condition where it constitutes a base module for use with screening devices of various kinds. Such screening devices comprise, as mentioned in the beginning, a body of screening material which can be rolled up (e.g. a roller blind), which can be collapsed (e.g. a Venetian blind) or which can be pleated (e.g. a pleated blind). The arrangement comprises a mounting bar 1 which is hollow in its entire length, two parallel guidance cords 2 and 3 led through the mounting bar 1 and installation brackets 4, 5, 6 and 7 in each of the free ends of the cords 2 and 3. One free end of the cord 2 is connected with the corresponding installation bracket 4 through a pretensioning spring 8 just as one free end of the cord 3 is connected with its installation bracket 5 through a corresponding spring 9.

An example of the mounting of the arrangement in a window, as shown in FIG. 1, will in the following be explained with reference to FIGS. 2–4.

The bracket 4 is fastened to the sash of the window shown in FIG. 2 and comprising a bottom member 10, a top member 11 and two side members 12, 13, by means of a bracket 14 fastened to the side member 12 near the top member 11. The bracket 14 can as indicated in FIG. 3 be designed as a snap lock for releasable engagement with the bracket 4. The opposite side sash member 13 is mounted with a bracket reversed in relation to the bracket 14, but designed in a corresponding way for engagement with the bracket 5 Subsequently, the brackets 6 and 7 are fastened to each their side sash member 13 and 12 at the sash bottom member 10 by means of brackets of which the left bracket 17 is shown in FIG. 4 and also designed as mutually reversed snap locks in order to obtain the position shown in FIG. 2.

A screening device can then in a manner known per se be fastened optionally, e.g. at the top sash member 11, and its screening body drawn out from its inactive position whereupon the bottom bar, profile rail or strip of the screening device are connected with the mounting bar 1, e.g. by means of clips. When moving a thus mounted screening device, the bottom bar will all the time be essentially parallel to the bottom and top member of both the sash and the main frame. The pretensioning springs 8 and 9 ensure that the parallel guidance cords 2 and 3 are tensioned all the time. These springs need, of course, not be positioned as illustrated, but can e.g. be built in the very bracket 4 in such a way that they are not immediately visible seen from the outside.

When using the mounting and parallel guidance arrangement with a blackout curtain, e.g. of the roller blind kind, separate lateral guide rails 18, 19, as shown in FIG. 5 where the mounting and parallel guidance arrangement is left out-for the sake of clarity, can be mounted on the side sash members 12, 13 for increased light-proofness. As an example, the lower ends of the guide rails 18, 19 can be connected to the lower brackets 17 and having been adjusted to the upper brackets 14, the rails 18, 19 are screwed firmly to the side sash members 12, 13. The bottom bar of the roller blind is subsequently guided into the top of the rails 18, 19 followed by a part of the screening body of the roller blind, i.e. the cloth, whereupon the roller tube of the roller blind together with a cover strip are fastened to the upper brackets 14. Finally, the bottom bar of the roller blind is, as described in the above, connected to the mounting bar 1 in the base module.

Alternatively, the mounting is initiated by fastening the lower brackets 6, 7 of the mounting and parallel guidance arrangement to each of their sash members 13, 12 at the sash bottom member 10 by means of the brackets 17.

In case the screening device has not yet been mounted in the window, it is placed with e.g. its top casing, e.g. a curtain cassette in the case of a roller blind, at the top sash member 11.

The upper brackets 4, 5 of the mounting and parallel guidance arrangement can then be connected with the top casing of the screening device by each bracket 4,5 retaining the top casing to the brackets 14 of the side sash members via end parts or insertion components for the screening devices.

Subsequently, the separate side guide rails 18, 19 can be mounted and e.g. be fixed by means of screws whereupon the bottom bar of the screening device, as in the above, is connected with the mounting bar in the mounting and parallel guidance arrangement.

The upper brackets 4, 5 can also be designed in such a way that they are merely connected with the casing of the screening device without this being retained to the window, e.g. by snap engagement whereby the side guide rails 18, 19 result in retaining the top casing to the window.

To all the mounting examples described in the above, it applies, however, that at any time, the mounting and the parallel guidance arrangement can usually be demounted without demounting the entire screening device.

It is also conceivable that the arrangement comprises a further screening body which at its one end is connected with the mounting bar and which at its free end is provided with a bottom bar, profile rail or strip for optional connection with either the mounting bar, i.e. in situations where the screening body is not used, or with the mounting bracket on the main frame or sash side members of the window when the screening body is in use.

The arrangement with the additional screening body comprises in that case a specially designed bottom bar, profile rail or strip being hollow over the entire length and where two parallel guidance cord systems individually can again be led through the said special bottom bar, profile rail or strip in such a way that the free ends of the said cord systems with the mounting brackets are fastened e.g. to the adjacent main frame or sash side members.

In the first case, there is obtained a possibility of mounting the additional screening body together with the usual screening body of the screening device in a simple way, and if these bodies are selected in an appropriate way, e.g. as to colour, translucence, etc., this implies, of course, a strongly increased flexibility in the use of the arrangement. In the latter case, there is further obtained the quality that the additional screening body in a simple way via the double parallel guidance can be positioned optionally in the window opening to cover an optional part hereof.

Both the mounting bar and the bottom bar can be provided with retaining members of which some contribute to the establishment of a interconnection between the two bars, especially in situations where the screening body is not to be used. Other retaining elements contribute to the establishing of a connection e.g. to a cover strip or casing for the first screening device.

The two bars permit a parallel guidance of each of these bars so that they may move independently in relation to each other.

Another not illustrated way of using the universal mounting and parallel guidance arrangement is to apply two or more several arrangements at the same time.

Between the mounting bars in the two adjacent arrangements, an independent screening device can be situated as a supplement to the screening device or devices positioned above and/or below in the window.

Figure 6:
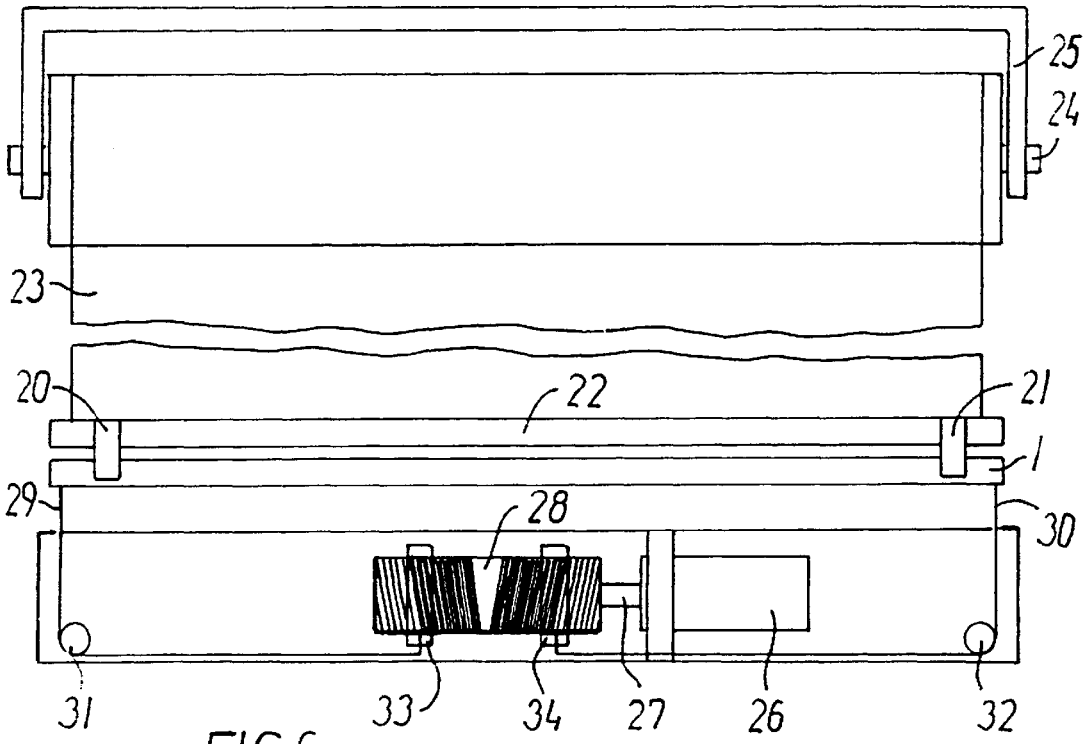

In FIG. 6, a development of the mounting and parallel guidance arrangement according to the invention is shown and provided at the lower sash member with a driving device known per se from WO 96/22447.

In this figure, only the mounting bar 1 of the mounting and parallel guidance arrangement is shown and said bar is connected by means of clips 20, 21 with the bottom bar 22 of a roller blind with a length of screening material which above is rolled up on a roller 24 which via brackets 25 is fastened to the sash top member.

The driving device comprises an electric drive motor 26 with a not further shown gear unit and is via a motor shaft 27 connected with a rolling-up device in the form of a drum 28. Two draw cords 29 and 30 are with one end connected with the mounting bar 1 and with another end via guide rolls 31, 32 led to and entwined round the drum 28. The two draw cords 29 and 30 may be replaced by one single cord which in that case is led through the entire mounting bar 1.

The drum is designed with threaded sections having mutually opposite pitch directions and each being in engagement with a nut element 33, 34 with corresponding thread. The nut elements 33, 34 are axially displaceable in relation to each other.

When rolling down the roller blind, the motor 26 drives the drum 28 via the motor shaft 27 and the nut elements 33, 34 move away from each other during simultaneous winding up of the draw cords 29, 30 which are being placed in the treads in each drum section whereby the mounting bar 1 and thus the bottom bar of the roller blind is drawn downwards in the direction of the bottom member of the sash and/or the main frame.

What is claimed is:

1. A universal mounting and parallel guidance arrangement for at least one screening device for a window, where the screening device comprises a body of screening material which in an idle position is rolled up, collapsed, or pleated and occupies a position in or at a main frame or sash member of the window, whereas said body has a free end connected to a bottom bar, profile rail or strip characterized in that the arrangement comprises:

at least one mounting bar (1) having a throughbore;

a releasable interconnection engaging said mounting bar for releasably connecting said mounting bar directly to the bottom bar, profile rail or strip of the screening device;

two parallel guidance cord systems (2, 3) each being led through said mounting bar and comprising end parts which protrude from each end of the mounting bar; and installation brackets (4–7) for the free end of each of the said end parts by which the two installation brackets (4, 6; 5, 7) for a cord system are fastenable at the top of a first main frame or sash side member and at the bottom of the other main frame or sash side member opposite in relation to the first one, respectively.

2. A mounting and parallel guidance arrangement according to claim 1, characterized in that the parallel guidance cord systems (2, 3) are tensioned.

3. A mounting and parallel guidance arrangement according claim 1, characterized in that the releasable interconnection comprises clips.

4. A mounting and parallel guidance arrangement according to claim 1, characterized in that each said installation bracket (4–7) connected with the respective free cord end is attached by a snap interconnection to a fixed bracket in the form of a premountable bracket (14, 17) adapted to be fastened on a main frame or sash side member.

5. A mounting and parallel guidance arrangement according to claim 1, characterized in that said installation bracket connected with the respective free cord end for each cord system is adapted for releasable interconnection with a casing for the screening device.

6. A mounting and parallel guidance arrangement according to claim 5, characterized in that said installation bracket is adapted for interconnection with a fixed bracket in the form of a premountable bracket to be fastened to a main frame or sash side member via an insertion component in each end of the casing of the screening device for its retaining to the main frame or sash member.

7. A mounting and parallel guidance arrangement according to claim 1 and for use with a blackout curtain, characterized in that it also comprises light-proof side guide rails (18, 19) to be mounted on the opposite main frame or sash side members (12, 13).

8. A mounting and parallel guidance arrangement according to claim 7, characterized in that said side guide rails are adapted for interconnection with at least one installation bracket (17).

9. A mounting and parallel guidance arrangement according to claim 1, characterized in that the mounting bar (1) is connected with at least one draw cord (29, 30) which is in connection with an electric operation device comprising a rewinding drum (28) for the draw cord mounted in or at the main frame or sash top or bottom member.

10. A mounting and parallel guidance arrangement according to claim 1, in which the parallel guidance cord systems are tensioned by a means for tensioning.

11. A mounting and parallel guidance arrangement according to claim 10 wherein the tensioning means comprises pretensioned springs connected to said installation brackets.

12. A universal mounting and parallel guidance arrangement in combination with at least one screening device for a window, where the screening device comprises a body of screening material which in an idle position is rolled up, collapsed, or pleated and occupies a position in or at a main frame or sash member of the window, whereas said body has a free end connected to a bottom bar, profile rail or strip characterized in that the arrangement comprises:

at least one mounting bar (1) having a throughbore;

a releasable interconnection between said mounting bar and the bottom bar, profile rail or strip of the screening device;

two parallel guidance cord systems (2, 3) each being led through said mounting bar and comprising end parts which protrude from each end of the mounting bar; and installation brackets (4–7) for the free end of each of the said end parts by which the two installation brackets (4, 6; 5, 7) for a cord system are fastenable at the top of a first main frame or sash side member and at the bottom of the other main frame or sash side member opposite in relation to the first one, respectively.

* * * * *